US009028036B1

(12) United States Patent
Bildstein et al.

(10) Patent No.: US 9,028,036 B1
(45) Date of Patent: May 12, 2015

(54) EDGE-JUSTIFIED PRINTING WITH A CROWNED ROLLER

(71) Applicants: Carl Bildstein, Lafayette, CO (US); Stuart Boland, Denver, CO (US); Scott Johnson, Erie, CO (US); Casey Walker, Boulder, CO (US)

(72) Inventors: Carl Bildstein, Lafayette, CO (US); Stuart Boland, Denver, CO (US); Scott Johnson, Erie, CO (US); Casey Walker, Boulder, CO (US)

(73) Assignee: Ricoh Company, Ltd., Tokyo (JP)

( * ) Notice: Subject to any disclaimer, the term of this patent is extended or adjusted under 35 U.S.C. 154(b) by 10 days.

(21) Appl. No.: 14/088,742

(22) Filed: Nov. 25, 2013

(51) Int. Cl.
*B41J 29/393* (2006.01)
*B41J 13/00* (2006.01)

(52) U.S. Cl.
CPC ..... *B41J 13/0009* (2013.01)

(58) Field of Classification Search
CPC ..... B41J 11/42; B41J 19/005
See application file for complete search history.

(56) References Cited

U.S. PATENT DOCUMENTS

| | | | | |
|---|---|---|---|---|
| 4,572,417 | A | 2/1986 | Joseph et al. | |
| 4,606,264 | A | 8/1986 | Agronin et al. | |
| 3,232,547 | A | 2/1996 | Thiede et al. | |
| 5,522,785 | A | 6/1996 | Kedl et al. | |
| 6,135,935 | A | 10/2000 | Kivioja et al. | |
| 6,543,867 | B1 * | 4/2003 | Jones | 347/7 |
| 6,595,460 | B1 | 7/2003 | Jones | |
| 8,562,101 | B2 * | 10/2013 | Calamita et al. | 347/19 |
| 8,727,473 | B2 * | 5/2014 | Calamita | 347/14 |
| 2013/0042804 | A1 | 2/2013 | Formicola et al. | |

* cited by examiner

*Primary Examiner* — Lamson Nguyen
(74) *Attorney, Agent, or Firm* — Duft Bornsen & Fettig LLP

(57) ABSTRACT

Systems and methods are provided for aligning an edge of a web of continuous-forms print media in a printer using a crowned roller. The system comprises an edge-justified printer, a crowned roller, and an adjustment mechanism. The edge-justified printer is configured to print to a continuous-forms web of print media that uses a margin as a target alignment point for an edge of the web. The crowned roller includes an apex that is a point where the diameter of the crowned roller is largest. The adjustment mechanism is configured to adjust a lateral position of the apex to align the edge of the web with the margin.

20 Claims, 10 Drawing Sheets

EDGE-JUSTIFIED PRINTING WITH A CROWNED ROLLER

FIELD OF THE INVENTION

The invention relates to the field of printing systems, and in particular, to aligning webs of media for continuous-forms printing systems.

BACKGROUND

Entities with substantial printing demands typically use a production printer. A production printer is a high-speed printer used for volume printing (e.g., one hundred pages per minute or more). Production printers include continuous-forms printers that print on a web of print media stored on a large roll.

A production printer typically includes a localized print controller that controls the overall operation of the printing system, and a print engine (sometimes referred to as an "imaging engine" or a "marking engine"). The print engine includes one or more printhead assemblies, with each assembly including a printhead controller and a printhead (or array of printheads). An individual printhead includes multiple (e.g., hundreds of) tiny nozzles that are operable to discharge ink as controlled by the printhead controller. A printhead array is formed from multiple printheads that are spaced in series across the width of the web of print media.

While the printer prints, the web is quickly passed underneath the nozzles, which discharge ink onto the web at intervals to form pixels. In order to ensure that the web is consistently positioned underneath the nozzles, steering systems can be used to align the web laterally with respect to its direction of travel. However, steering systems often use even-profile rollers that have little positional control of the lateral movements of web traveling through a continuous-forms printing system.

SUMMARY

Embodiments described herein align an edge of a web of print media in an edge-justified printer system using a crowned roller. As the web travels through the printer system, the point of largest diameter along the crowned roller tends to position the center of the web at that point. Therefore, a change in position of the crowned roller imparts a corresponding change in position of a traveling web. For an edge-justified printer, the controlled adjustment of a crowned roller allows webs of different width sizes to be aligned at a common edge within the printing system.

One embodiment is a system that includes an edge justified printer, a crowned roller, and an adjustment mechanism. The edge justified printer is configured to print to a continuous-forms web of print media that uses a margin as a target alignment point for an edge of the web. The crowned roller includes an apex that is a point where the diameter of the crowned roller is largest. The adjustment mechanism is configured to adjust a lateral position of the apex to align the edge of the web with the margin.

Another embodiment is a method for edge-justified printing using a crowned roller. The method includes identifying a margin of an edge justified printer. The margin is a target alignment point for an edge of a web of print media in the edge-justified printer. The method also includes detecting that the edge of the web is not aligned with the margin. The method further includes adjusting a lateral position of an apex of a crowned roller to align the edge of the web with the margin, the apex being a point where a diameter of the crowned roller is largest.

Another embodiment is a continuous-forms printing system. The printing system includes a printer configured to print to webs of various width sizes and a frame configured to support one or more rollers that transport the webs through the printer. The printing system also includes a crowned roller configured to tension the webs with an apex that is a point where a diameter of the crowned roller is largest. The printing system further includes a controller. The controller is configured to receive information regarding a web width change, and to adjust the position of the crowned roller in the frame. The adjustment is made in accordance with the web width change to align a common edge of each of the webs to a common location in the frame despite the web width change.

Other exemplary embodiments (e.g., methods and computer-readable media relating to the foregoing embodiments) may be described below.

DESCRIPTION OF THE DRAWINGS

Some embodiments of the present invention are now described, by way of example only, and with reference to the accompanying drawings. The same reference number represents the same element or the same type of element on all drawings.

DETAILED DESCRIPTION

The figures and the following description illustrate specific exemplary embodiments of the invention. It will thus be appreciated that those skilled in the art will be able to devise various arrangements that, although not explicitly described or shown herein, embody the principles of the invention and are included within the scope of the invention. Furthermore, any examples described herein are intended to aid in understanding the principles of the invention, and are to be construed as being without limitation to such specifically recited examples and conditions. As a result, the invention is not limited to the specific embodiments or examples described below, but by the claims and their equivalents.

Figure 1:
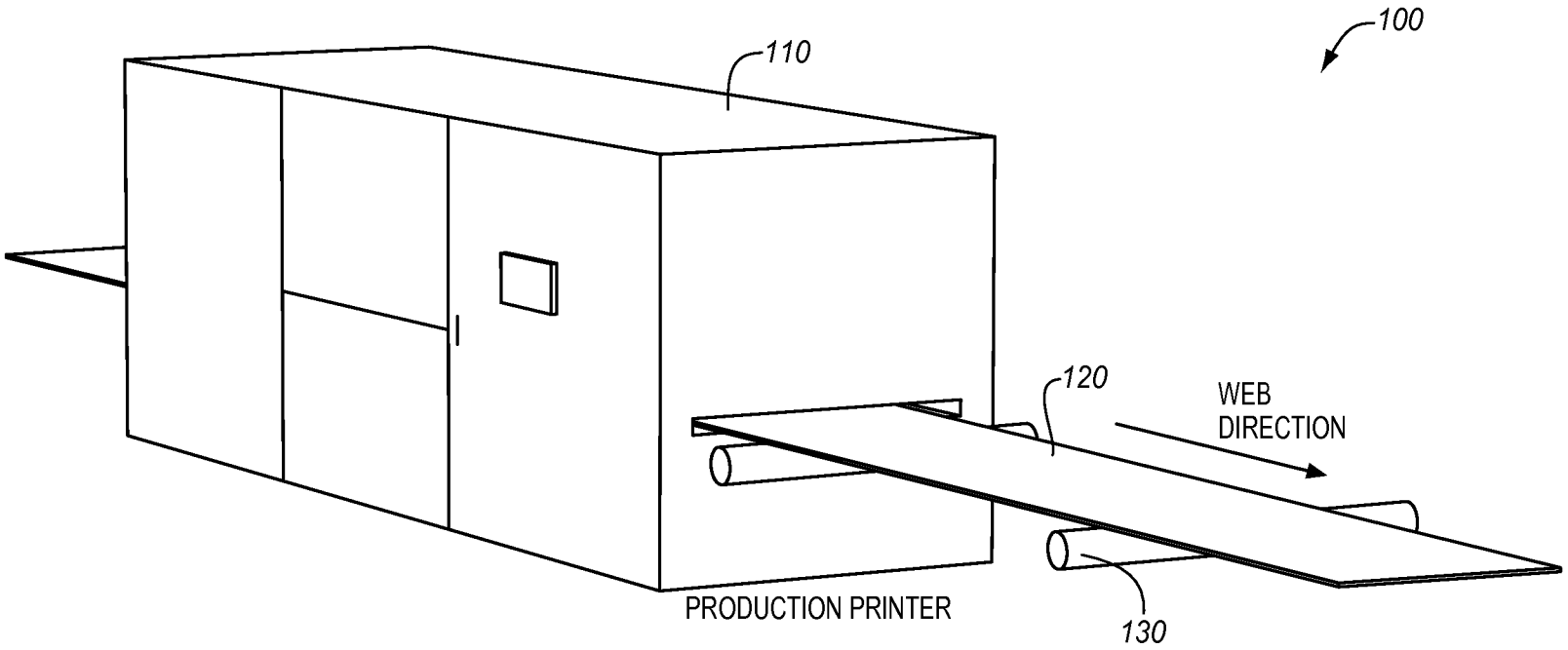
FIG. 1 illustrates an exemplary continuous-forms printing system.

FIG. 1 illustrates an exemplary continuous-forms printing system 100. Printing system 100 includes production printer 110, which is operable to apply ink onto a web 120 of continuous-form print media (e.g., paper). As used herein, the word "ink" is used to refer to any suitable marking fluid that can be applied by a printer (e.g., aqueous inks, oil-based paints, etc.). Printer 110 may comprise an inkjet printer that applies colored inks, such as Cyan (C), Magenta (M), Yellow (Y), and Key (K) black inks. One or more rollers 130 position web 120 as it travels through printing system 100.

Figure 2:
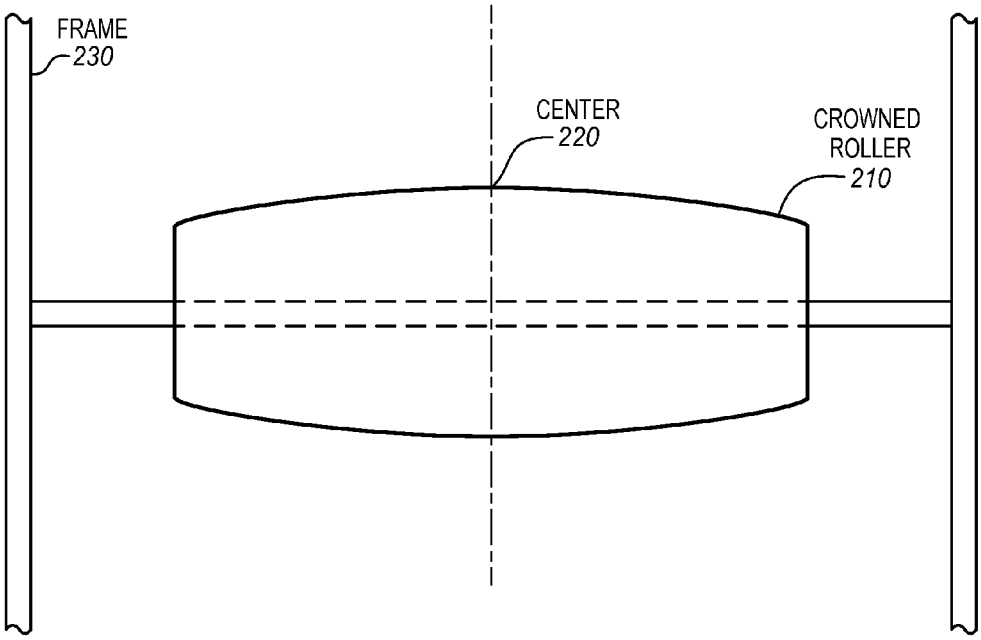
FIG. 2 illustrates an exemplary crowned roller.

FIG. 2 illustrates an exemplary crowned roller 210 that may be used in a printing system, such as printing system 100. The shape of the crowned roller 210 is generally cylindrical with a center 220 that is larger than the sides of the crowned roller 210. When a web of print media travels across the crowned roller 210, the web tends to center itself about the center 220 of the crowned roller due to the increased tension at that point. In previous systems, the crowned roller 210 and the center 220 are fixed in place within a frame 230 of the printing system (and usually centered within the frame 230, as shown in FIG. 2) so that the web does not shift laterally during printing. As used herein, a lateral shift is a positional change that is within the plane of the web and orthogonal to the direction of travel of the web (i.e., orthogonal to the length of the web, and parallel to the width of the web).

However, while the crowned roller 210 reduces lateral shifting of a web, a new web with a smaller or larger width than a previous web will center itself at the same location as the previous web and therefore have a different edge alignment within a printing system. Because of this, crowned rollers of previous systems cannot be used in edge-justified printing systems. An edge justified printing system configures components of the printing system (e.g., printheads, upstream/downstream components, etc.) to align with respect to an edge, or side, of a web of print media that travels through the printing system.

Figure 3:
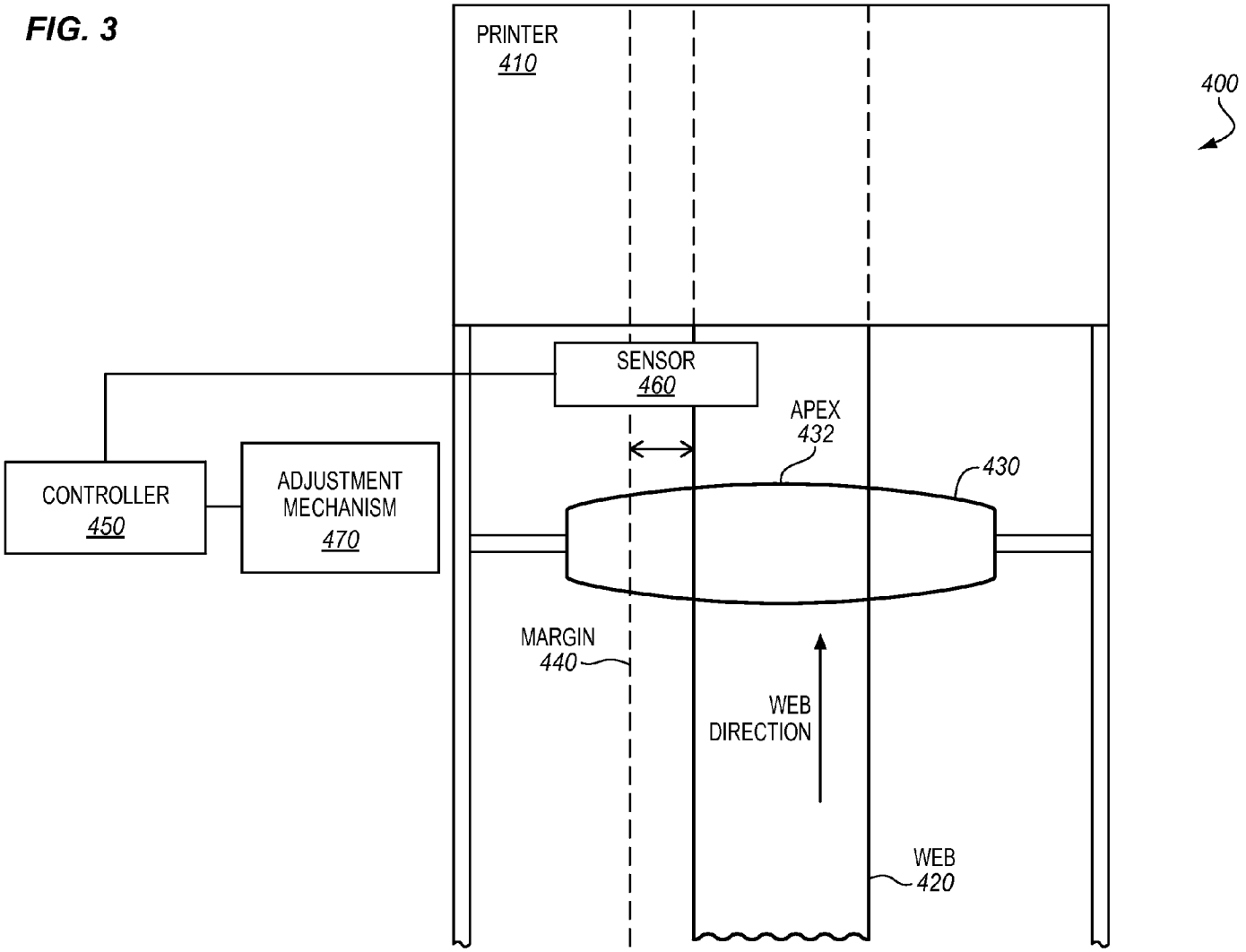
FIG. 3 is a block diagram illustrating an exemplary printing system that uses a crowned roller for edge justified printing.

FIG. 3 is a block diagram illustrating an exemplary printing system 400 that uses a crowned roller for edge-justified printing. Printing system 400 includes a printer 410 capable of edge-justified printing onto the web 420 and a margin 440 which is a target alignment point for an edge of the web 420. Printing system 400 is enhanced with a crowned roller 430, a sensor 460, a controller 450, and an adjustment mechanism 470 that collectively adjust an apex 432 of the crowned roller 430 to align the edge of the web 420 with the margin 440 for edge justified printing.

The crowned roller 430 is any type of roller with an uneven profile. The apex 432, although shown in FIG. 4 as located at the center of the crowned roller 430, may be any point along a longitudinal axis of the crowned roller 430 where a diameter of the crowned roller 430 is largest. The web 420 tends to center itself about the apex 432, therefore an adjustment of the apex 432 imparts a corresponding lateral shift of the web 420. Thus, the adjustment mechanism 470 can enable edge-justified printing using a crowned roller 430 by moving the apex 432 to a lateral location such that the edge of the web 420 is aligned with the margin 440.

Printing system 400 comprises any system, component, or device operable to mark a web 420 of print media in an edge justified fashion. As discussed above, various components of an edge-justified printing system, such as printheads, are aligned with respect to an edge of the web 420. As such, in an edge-justified printing system, webs with different width sizes have a common lateral location of a respective common edge despite the change in web width size.

A lateral location is some point along a lateral direction of the printing system 400, the lateral direction being orthogonal to the direction of travel of the web (i.e., orthogonal to the length of the web, and parallel to the width of the web). The particular reference point and lateral distance used to define a lateral location of the margin 440 is a matter of design choice. Additionally, the side or common edge (i.e., right or left edge) of the webs of varying width sizes that is aligned with the margin 440 is a matter of design choice.

The sensor 460 comprises any system, component, or device operable to detect a lateral location of one or more edges of the web 420 with respect to the margin 440. For example, the sensor 460 can comprise a laser, pneumatic, photoelectric, ultrasonic, infrared, optical, or any other suitable type of sensing device. The sensor 460 can be placed upstream or downstream of other components (e.g., crowned roller 430 or adjustment mechanism 470) as desired.

The controller 450 comprises any system, component, or device operable to control the adjustment mechanism 470 based on the lateral location of the web 420 detected by sensor 460. Controller 450 can be implemented, for example, as custom circuitry, as a processor executing programmed instructions stored in an associated program memory, or some combination thereof. The adjustment mechanism 470 comprises any system, component, or device operable to adjust the lateral position of web of the apex 432 of the crowned roller 430. Illustrative details of the operation of printing system 400 will be discussed with regard to FIG. 5.

Figure 4:
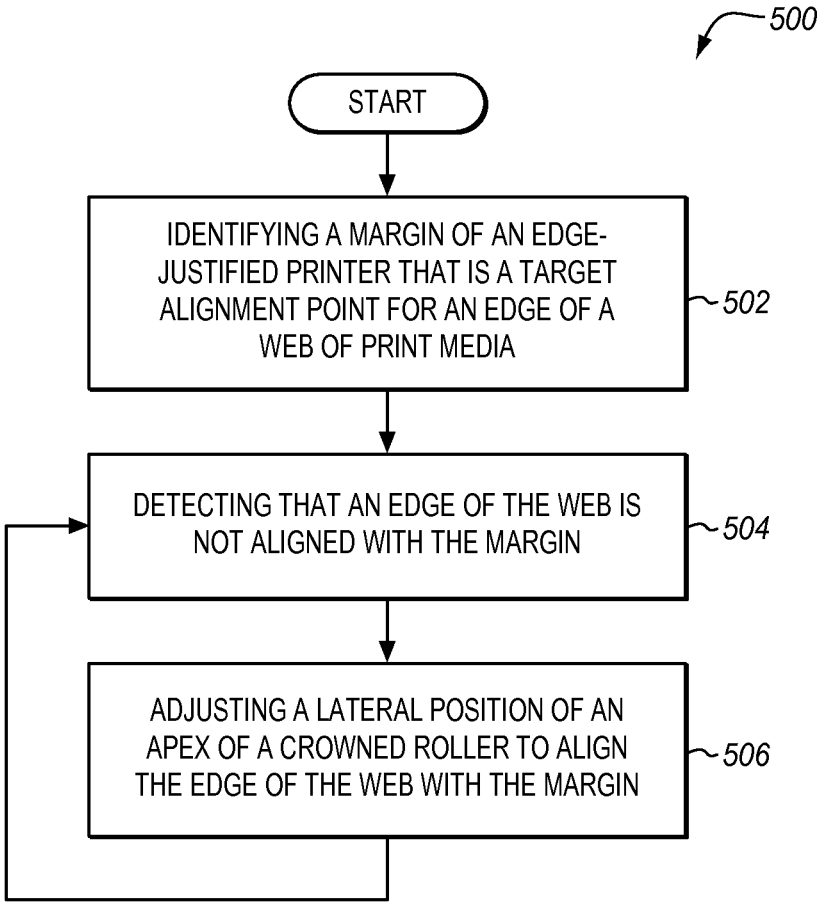
FIG. 4 is a flowchart illustrating an exemplary method of edge-justified printing using a crowned roller.

FIG. 4 is a flowchart illustrating an exemplary method of aligning an edge of a web of print media in an edge-justified continuous-forms using a crowned roller. The steps of method 500 are described with reference to printing system 400 of FIG. 3, but those skilled in the art will appreciate that method 500 may be performed in other systems. The steps of the flowcharts described herein are not all inclusive and may include other steps not shown. The steps described herein may also be performed in an alternative order.

In step 502, a margin 440 of the printing system 400 is identified. As discussed above, the margin 440 is a target alignment point for an edge of the web 420 as it travels through the printing system 400. The margin 440 may be inherent to a printing system 400 and/or determined or set by an operator and/or the controller 450 of the printing system 400.

In step 504, the sensor 460 detects that the edge of the web 420 is not aligned with the margin 440. Then, at step 506, the adjustment mechanism 470 adjusts a lateral position of the apex 432 of the crowned roller 430 to align the edge of the web 420 with the margin 440. In one embodiment, the adjustment mechanism 470 is directed automatically by the controller 450 which shifts the crowned roller 430 and its apex 432 in a lateral direction based on information received from the sensor 460. Additionally or alternatively, the adjustment mechanism 470 is directed manually by a user of the printing system 400.

One or more steps of method 500 may repeat multiple times during printing. For example, the sensor 460 and controller 450 may continually detect and adjust the lateral location of the edge of the web 420 during printing to maintain edge alignment with the margin 440 and compensate for lateral shifts in the web 420. Alternatively or additionally, one or more steps of the method 500 may be triggered by a change of width of the web 420 of the printing system 400.

In one embodiment, the controller 450 may receive input from a user or the sensor 460 that a new web and/or web width that has been placed in the printing system 400. In response, the controller 450 may pause print operation and direct an appropriate lateral shift of the apex 432 to reposition an edge of the new web with the margin 440. Additionally, the controller 450 may resume print operation when the new web has been aligned with the margin 440.

The controller 450 may also be configured to activate or deactivate printheads of the printer 410 in accordance with the change in web width. For example, suppose a wide web replaces a narrow web in the printing system. The controller 450 may align a side of the wide web with the margin and then activate printheads on the opposite side of the aligned edge that were unused for the narrow web. When the narrow web replaces the wide web, the controller 450 may deactivate printheads in accordance with the narrower, edge-justified printing area. Further description and additional features may be found in the examples described below.

EXAMPLES

In the following examples, additional processes, systems, and methods are described in the context of a printing system that adjusts a lateral position of the apex 432 of a crowned roller 430 for edge-justified printing.

Figure 5:
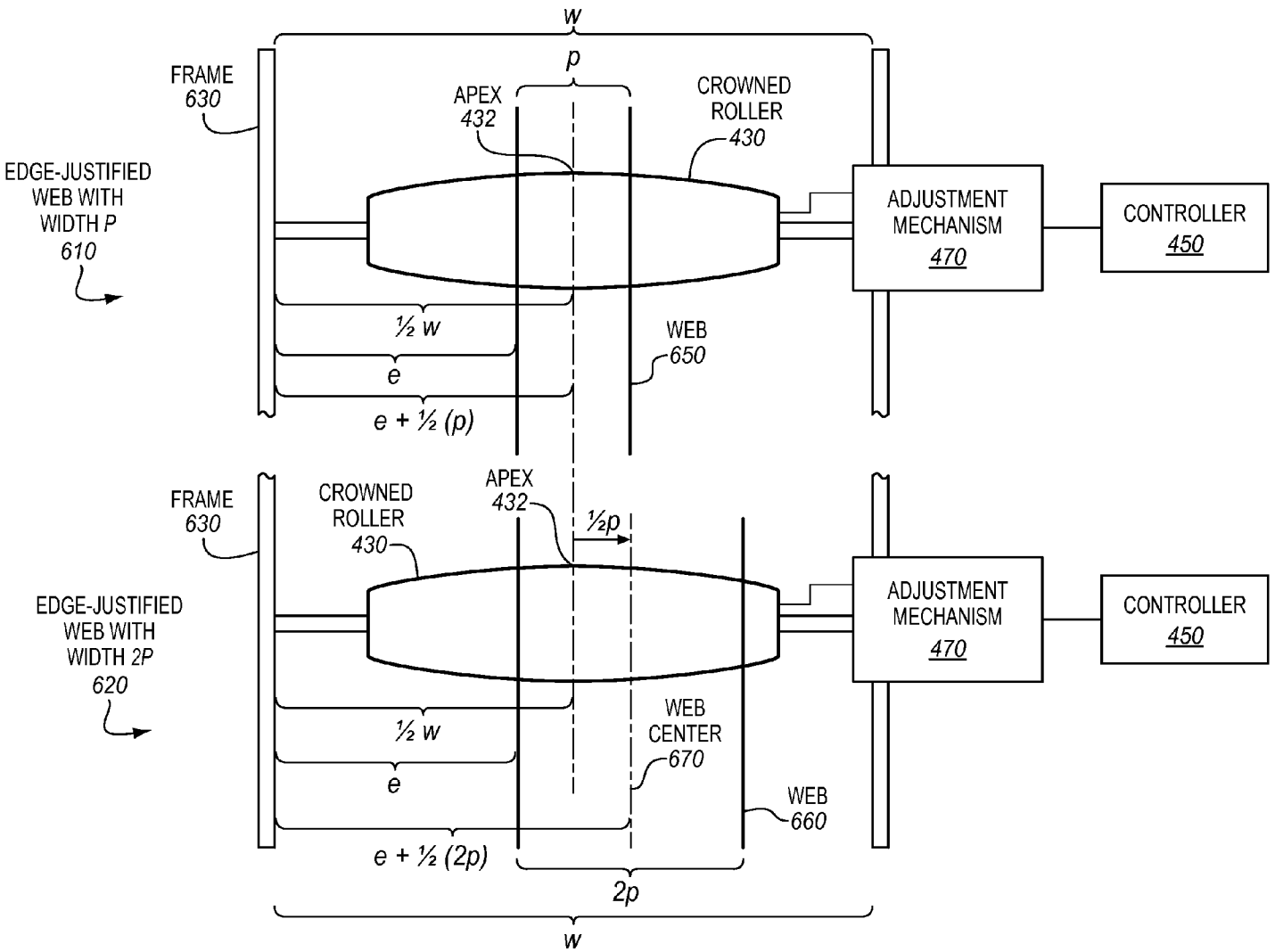
FIG. 5 is a block diagram illustrating an exemplary edge-justified printing system with a crowned roller and multiple web widths.

FIG. 5 is a block diagram illustrating an exemplary crowned roller system capable of edge justifying multiple web widths. As can be seen at element 610, a web 650 with width p is positioned on a crowned roller 430 with apex 432, the crowned roller 430 being connected to a frame 630 of a printing system with width w. A continuous-forms printer, such as printer 410, may be located downstream from the crowned roller 430 with respect to a direction of web travel. The frame 630 extends through a printing area of the printer and the crowned roller 430 may be attached to at a location on the frame 630 within the interior of the printer or alternatively attached to a location on the frame 630 outside of the printer.

It is assumed, for the sake of the embodiment, that the web 650 is edge-justified at a lateral location such that the edge of the left side of the web 650 is a lateral distance e from the left side of the frame 630 of a printing system. In other words, the margin is located at lateral distance e from one side of the frame 630 and aligns each web with respect to a common left edge. It will be appreciated, however, that the particular web edge and frame side (i.e. right or left) and margin reference point (i.e., frame 630) are merely exemplary for the purposes of explanation and are not intended to be limiting.

At element 610, the web 650 is centered about the apex 432 in the middle of the frame 630

$$\left(\text{e.g., } \frac{1}{2}w\right).$$

Also, with respect to the left side of the frame 630, the center of the web 650 is located at a distance $$\left(e + \frac{1}{2}p\right).$$

With the apex 432 of the crowned roller 430 located at this position, the edge of web 650 is aligned at lateral distance e for edge-justified printing. However, when a new web with a differently manufactured web width size (e.g., web 660 with width 2p in element 620) is positioned in the exemplary crowned roller system, the apex 432 is laterally re-positioned by the controller 450 and/or the adjustment mechanism 470 to maintain a constant edge alignment at margin e of the new web 660. In this example, since the width of web 660 is twice that of web 650, when the left edge of web 660 is aligned with the margin e, the web center 670 is located at a lateral distance of $$\left(e + \frac{1}{2}(2p)\right).$$

As such, the controller 450/adjustment mechanism 470 translates the apex 432 of the crowned roller 430 to the right a distance of $$\left(\frac{1}{2}p\right)$$

so that the edge of web 660 is edge-justified to the margin e despite the change in web width size.

Further exemplary embodiments of a laterally translating apex of a crowned roller will be described in FIGS. 6-9. While FIGS. 6-9 are described with reference to the example of FIG. 5, those skilled in the art will appreciate that the embodiments are not limited as such. For instance, the controller 450 and/or adjustment mechanism 470 can edge justify in accordance with any increase or decrease in web width size and is not limited to the example of FIG. 5 where the web width size is doubled and the apex is adjusted to the right. Moreover, one skilled in the art would recognize that features and components of different embodiments may be combined.

Figure 6:
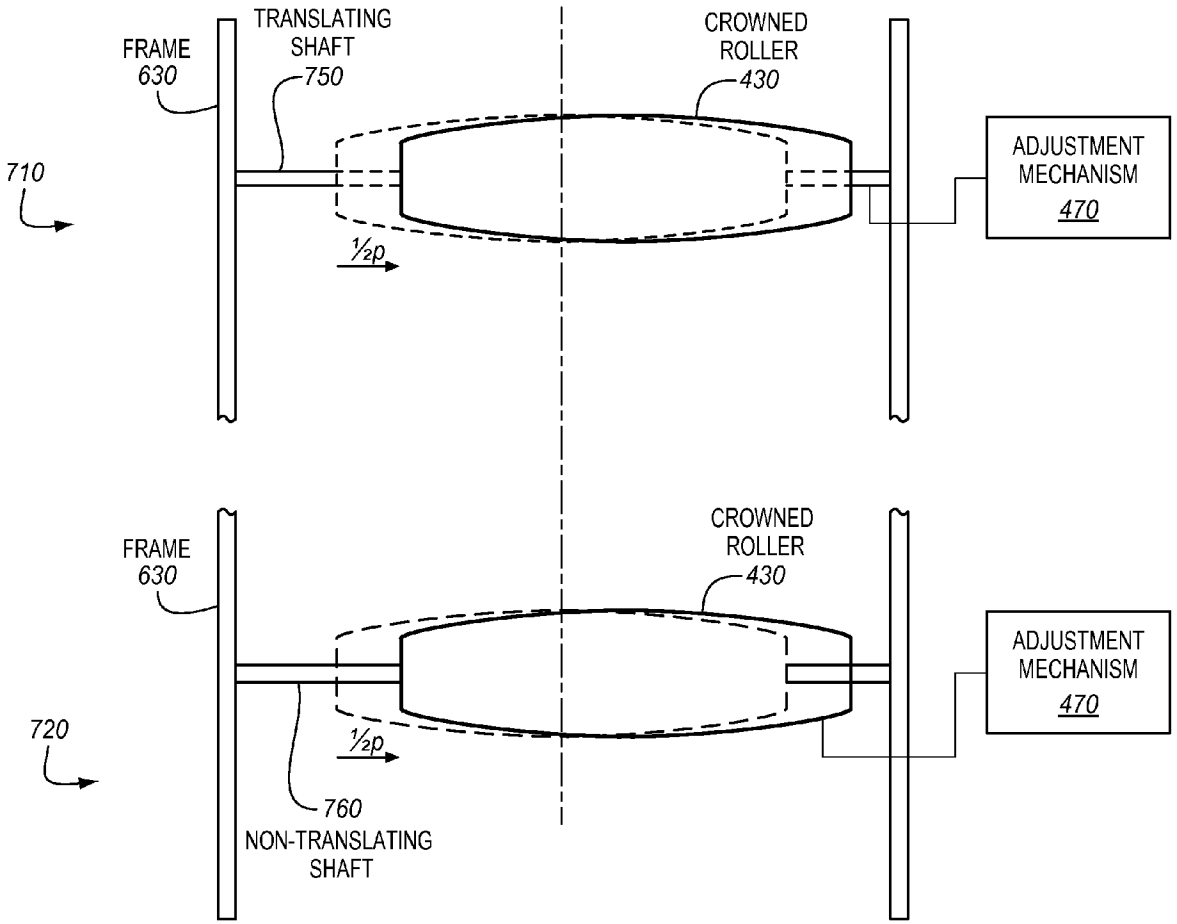
FIG. 6 illustrates exemplary embodiments of a laterally translating apex of a crowned roller.

FIG. 6 illustrates exemplary embodiments of a laterally translating apex of a crowned roller. In element 710, the adjustment mechanism 470, shifts the apex of the crowned roller to the right by a distance $$\left(\frac{1}{2}p\right)$$

to accommodate new wet) width 2p) by adjusting a translating shaft 750 to which the crowned roller 430 is laterally affixed. The lateral movement of the translating shaft 750 causes a corresponding lateral movement of the apex of the crowned roller 430. As seen in FIG. 6, the dashed outline of the crowned roller 430 and translating shaft 750 show their position within the frame prior to the lateral adjustment. In one embodiment, the crowned roller 430 rotates about the translating shaft 750 which is non-rotating. Alternatively, the crowned roller 430 may rotate along with the translating shaft 750 which rotates within frame mounted compound bearings and which may be driven by a motor. Adjustment mechanism 470 may be manual or directed by a controller 450 receiving edge alignment information from one or more sensors.

In another embodiment, such as in element 720, the adjustment mechanism 470 shifts the apex of the crowned roller to the right by a distance $$\left(\frac{1}{2}p\right)$$

to accommodate a new web width 2p by adjusting the crowned roller 430 along the longitudinal axis of a non-translating shaft 760. The non-translating shaft 760 is laterally affixed in the frame 630 and the crowned roller 430 translates along the non-translating shaft 760 under the force of the adjustment mechanism 470. The non-translating shaft 760 may be rotatable and/or driven or alternatively be non-rotatable. Adjustment mechanism 470 may be manual or directed by a controller 450 receiving edge alignment information from one or more sensors.

Figure 7:
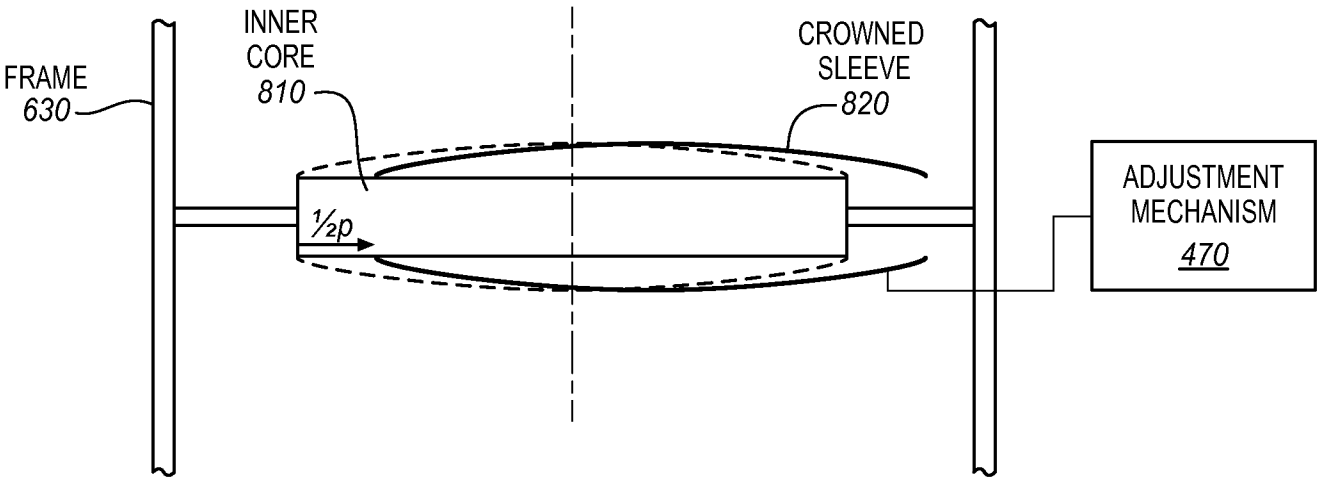
FIG. 7 illustrates another exemplary embodiment of a laterally translating apex of a crowned roller.

FIG. 7 illustrates another exemplary embodiment of a laterally translating apex of a crowned roller. In this embodiment, the crowned roller is comprised of an inner core 810 and a crowned sleeve 820 that fits and/or attaches around the outside of the inner core 810. The apex of the crowned roller is located at a point along the crowned sleeve 820. In one embodiment, the inner core 810 is laterally affixed within the frame 630 and the crowned sleeve 820 translates along the inner core 810 under the force of the adjustment mechanism 470. The crowned sleeve 820 may rotate around the inner core 810 for web transport, or alternatively, the inner core 810 and crowned sleeve 820 may rotate together about a shaft attached to the frame 630.

In an alternative embodiment, the inner core 810 is laterally adjustable within the frame 630 and the crowned sleeve 820 is laterally attached such that it translates with the inner core 810. As above, the crowned sleeve 820 may rotate around the inner core 810 for web transport, or alternatively, the inner core 810 and crowned sleeve 820 may rotate together about a shaft attached to the frame 630. In any case, continuing with the example where web 660 with width 2p replaces web 650 with width p, the apex (being formed by the profile of the crowned sleeve 820) is adjusted to the right a lateral distance $$\left(\frac{1}{2}p\right)$$

by the adjustment mechanism 470 so that a common edge of the webs 650/660 is aligned with a margin. Adjustment mechanism 470 may be manual or directed by a controller 450 receiving edge alignment information from one or more sensors.

Figure 8:
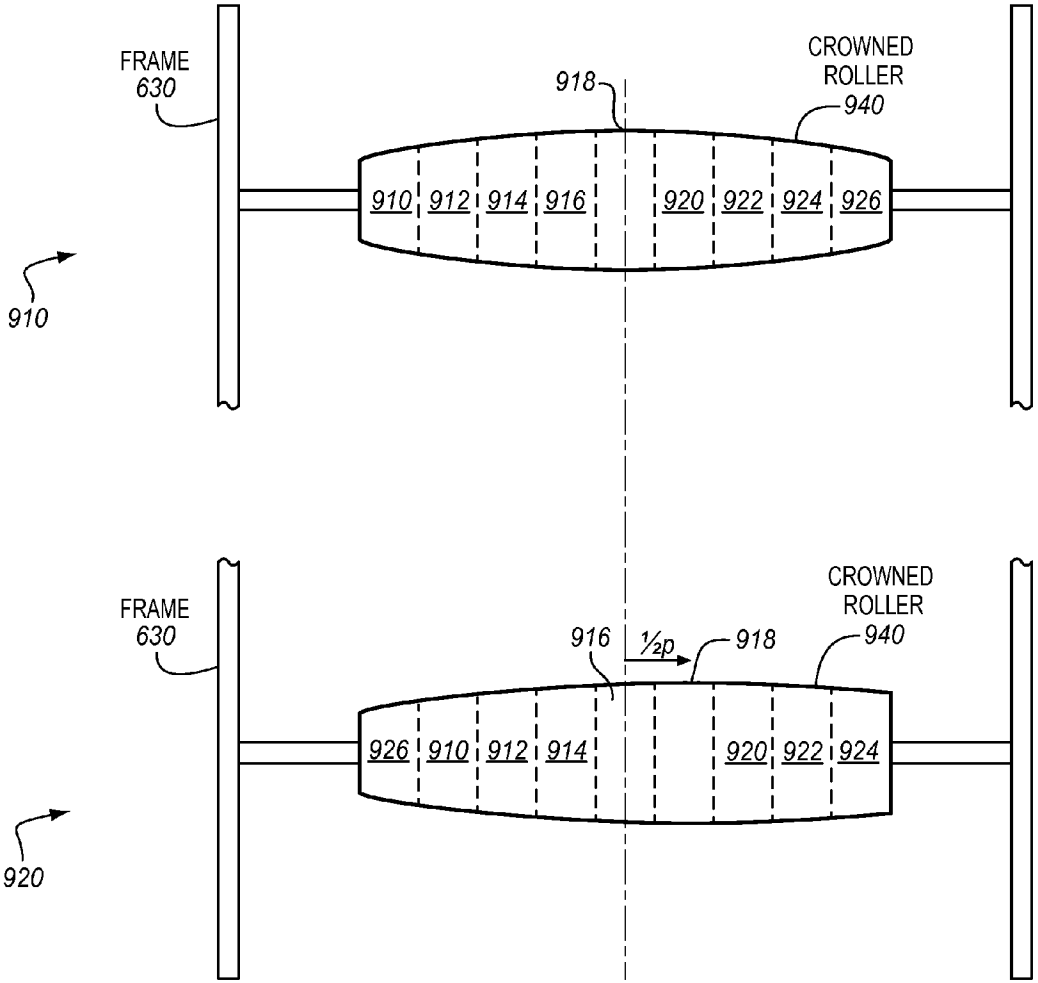
FIG. 8 illustrates an exemplary reconfigurable apex of a crowned roller.

FIG. 8 illustrates an exemplary reconfigurable apex of a crowned roller. In FIG. 8, the crowned roller 940 is comprised of multiple, consecutive cylindrical pieces 910-926. Each of the pieces 910-926 are rotatable about a shaft or axle attached to a frame 630. Additionally, each of the pieces 910-926 can be removed and/or reconfigured on the shaft or some longitudinal axis of the crowned roller. For example, as illustrated in elements 910 and 920, a repositioning of piece 926 to the other end of the crowned roller adjusts the apex, which is included in piece 918, to the right by a distance $$\left(\frac{1}{2}p\right).$$

As such, the position of one or both ends of the crowned roller 940 are unchanged in the frame 630, but the repositioning of one or more pieces nonetheless adjusts the apex so that web 660 with width 2p is properly aligned for edge-justified printing. The pieces 910-926 may rotate independently or alternatively may connect to rotate together. Additionally, spacers and/or lateral repositioning of the entire crowned roller 940 may be used in combination for precise lateral location of the apex.

Figure 9:
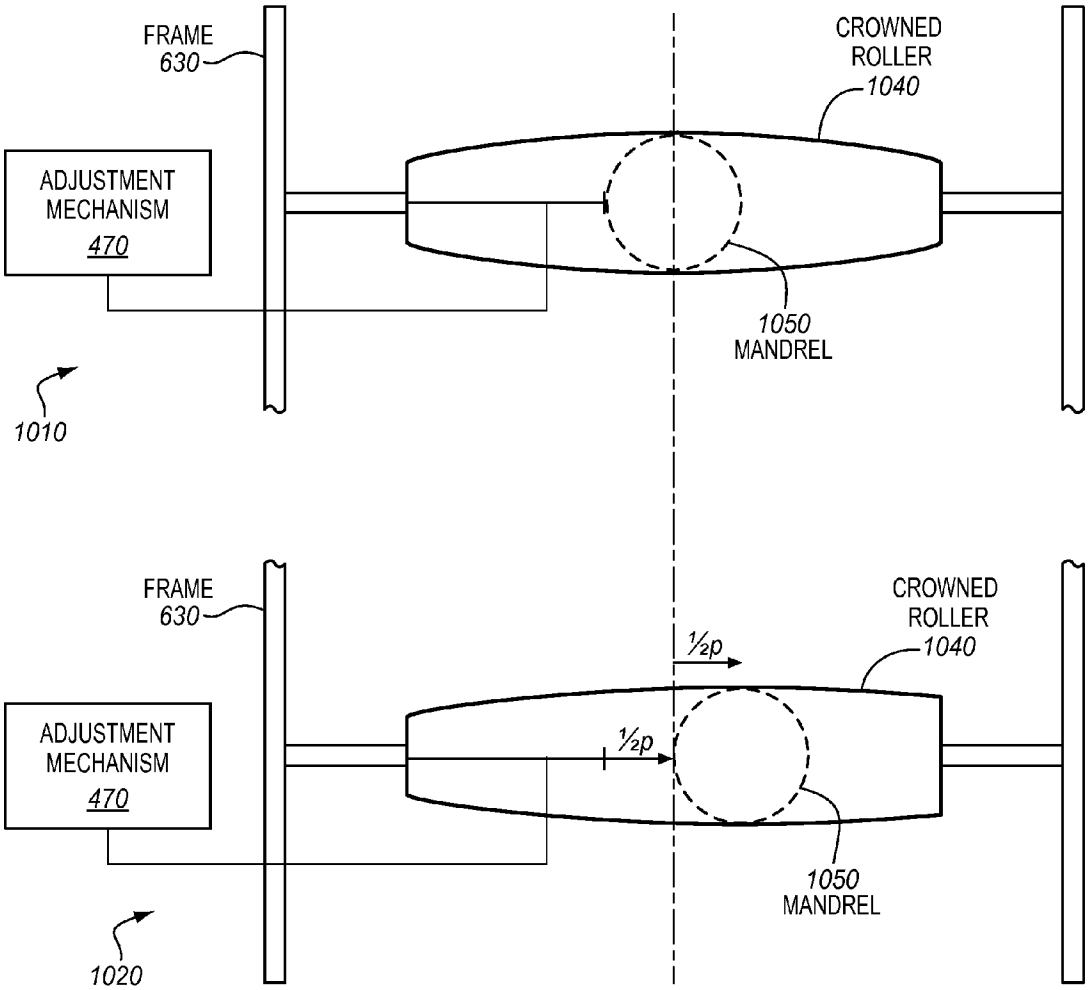
FIG. 9 illustrates another exemplary reconfigurable apex of a crowned roller.

FIG. 9 illustrates another exemplary reconfigurable apex of a crowned roller. In FIG. 9, the crowned roller 1040 has a hollow body and includes an internal mandrel 1050 that is a shape slightly larger than the inside diameter of the crowned roller 1040. The mandrel 1050 is laterally adjustable along the longitudinal axis of the crowned roller 1040. The position of the oversized portion of the mandrel 1050 causes an apex to form on the body of the crowned roller 1040. In one embodiment, the mandrel 1050 is mounted on a lead screw that is driven by the adjustment mechanism 470. As shown in elements 1010 and 1020, the oversized portion of the mandrel is driven to the right by a distance $$\left(\frac{1}{2}p\right)$$

to accommodate a web width change from p to 2p. Adjustment mechanism 470 may be manual or directed by a controller 450 receiving edge alignment information from one or more sensors.

Figure 10:
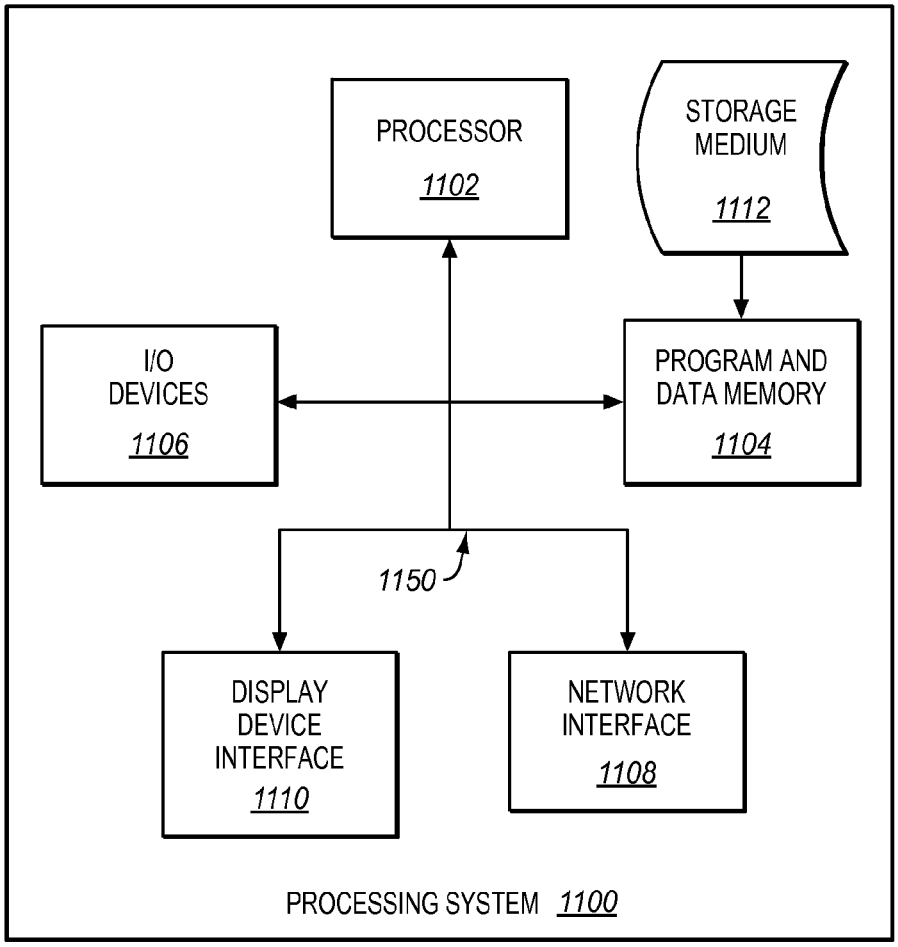
FIG. 10 illustrates a processing system operable to execute a computer readable medium embodying programmed instructions to perform desired functions in an exemplary embodiment.

Embodiments disclosed herein can take the form of software, hardware, firmware, or various combinations thereof. In one particular embodiment, software is used to direct a processing system of controller 450 to perform the various operations disclosed herein. FIG. 10 illustrates a processing system 1100 operable to execute a computer readable medium embodying programmed instructions to perform desired functions in an exemplary embodiment. Processing system 1100 is operable to perform the above operations by executing programmed instructions tangibly embodied on computer readable storage medium 1112. In this regard, embodiments of the invention can take the form of a computer program accessible via computer-readable medium 1112 providing program code for use by a computer or any other instruction execution system. For the purposes of this description, computer readable storage medium 1112 can be anything that can contain or store the program for use by the computer.

Computer readable storage medium 1112 can be an electronic, magnetic, optical, electromagnetic, infrared, or semiconductor device. Examples of computer readable storage medium 1112 include a solid state memory, a magnetic tape, a removable computer diskette, a random access memory (RAM), a read-only memory (ROM), a rigid magnetic disk, and an optical disk. Current examples of optical disks include compact disk-read only memory (CD-ROM), compact disk-read/write (CD-R/W), and DVD.

Processing system 1100, being suitable for storing and/or executing the program code, includes at least one processor 1102 coupled to program and data memory 1104 through a system bus 1150. Program and data memory 1104 can include local memory employed during actual execution of the program code, bulk storage, and cache memories that provide temporary storage of at least some program code and/or data in order to reduce the number of times the code and/or data are retrieved from bulk storage during execution.

Input/output or I/O devices 1106 (including but not limited to keyboards, displays, pointing devices, etc.) can be coupled either directly or through intervening I/O controllers. Network adapter interfaces 1108 may also be integrated with the system to enable processing system 1100 to become coupled to other data processing systems or storage devices through intervening private or public networks. Modems, cable modems, IBM Channel attachments, SCSI, Fibre Channel, and Ethernet cards are just a few of the currently available types of network or host interface adapters. Display device interface 1110 may be integrated with the system to interface to one or more display devices, such as printing systems and screens for presentation of data generated by processor 1102.

Although specific embodiments were described herein, the scope of the invention is not limited to those specific embodiments. The scope of the invention is defined by the following claims and any equivalents thereof.

We claim:

1. A system comprising:

an edge-justified printer configured to print to a continuous-forms web of print media that uses a margin as a target alignment point for an edge of the web;

a crowned roller including an apex that is a point where a diameter of the crowned roller is largest; and an adjustment mechanism configured to adjust a lateral position of the apex to align the edge of the web with the margin.

2. The system of claim 1 further comprising:

a sensor configured to detect whether the edge of the web is aligned with the margin; and a controller configured to direct the adjustment mechanism based on input from the sensor to maintain alignment of the web with the margin.

3. The system of claim 1 further comprising:

a shaft connected to a frame of the system, the crowned roller rotatable about the shaft;

wherein the adjustment mechanism is configured to adjust the crowned roller in a lateral direction along the shaft to adjust the lateral position of the apex.

4. The system of claim 1 further comprising:

a shaft connected to a frame of the system, the crowned roller rotatable about the shaft;

wherein the adjustment mechanism is configured to adjust the shaft in a lateral direction to adjust the lateral position of the apex.

5. The system of claim 1 wherein:

the crowned roller comprises:

an inner core supported by a shaft connected to a frame; and a sleeve including the apex of the crowned roller and configured to fit around the inner core, the sleeve being translatable in a lateral direction along the inner core.

6. The system of claim 1 wherein:

the crowned roller includes an internal mandrel adjustable in a lateral direction within the crowned roller and having a size larger than a diameter of the crowned roller to form the apex of the crowned roller.

7. The system of claim 1 wherein:

the crowned roller comprises a plurality of consecutive cylindrical pieces having different diameters;

wherein the order of the plurality of consecutive cylindrical pieces is reconfigurable such that a location of a piece that includes the apex is adjustable along a longitudinal axis of the crowned roller.

8. A non-transitory computer readable medium embodying programmed instructions which, when executed by a processor, are operable to perform a method comprising:

identifying a margin of an edge-justified printer that is a target alignment point for an edge of a web of print media in the edge-justified printer;

detecting that the edge of the web is not aligned with the margin; and adjusting a lateral position of an apex of a crowned roller to align the edge of the web with the margin, the apex being a point where a diameter of the crowned roller is largest.

9. The medium of claim 8 further comprising:

detecting a new web with a change in web width; and adjusting the lateral position of the apex based on the change in web width to maintain alignment with the margin.

10. The medium of claim 8 wherein adjusting of the lateral position of the apex comprises:

adjusting the crowned roller in a later direction along a longitudinal axis of a shaft.

11. The medium of claim 8 wherein adjusting of the lateral position of the apex comprises:

adjusting a shaft in a lateral direction, the crowned roller laterally affixed to the shaft.

12. The medium of claim 8 wherein adjusting of the lateral position of the apex comprises:

adjusting an internal mandrel in a lateral direction within the crowned roller, the internal mandrel having a size larger than a diameter of the crowned roller to form the apex of the crowned roller.

13. The medium of claim 8 wherein adjusting of the lateral position of the apex comprises:

reconfiguring a piece of the crowned roller that includes the apex, the crowned roller comprised of a plurality of consecutive cylindrical pieces having different diameters.

14. A continuous-forms printing system comprising:

a printer configured to print to webs of various width sizes;

a frame configured to support one or more rollers that transport the webs through the printer;

a crowned roller configured to tension the webs with an apex that is a point where a diameter of the crowned roller is largest; and a controller configured to receive information regarding a web width change, and to adjust the position of the crowned roller in the frame in accordance with the web width change to align a common edge of each of the webs to a common location in the frame despite the web width change.

15. The continuous-forms printing system of claim 14 wherein:

the controller is further configured to receive information regarding the web width change from a user.

16. The continuous-forms printing system of claim 15 wherein:

the controller is further configured to pause printer operation, and to resume printer operation when an edge of a new web is aligned at the common location.

17. The continuous-forms printing system of claim 14 wherein:

the controller is further configured to receive information regarding the web width change from a sensor.

18. The continuous-forms printing system of claim 17 wherein:

the controller is further configured to pause printer operation, and to resume printer operation when an edge of a new web is aligned at the common location.

19. The continuous-forms printing system of claim 14 wherein:

the controller is further configured to activate printheads in the printer when the web width change increases.

20. The continuous-forms printing system of claim 14 wherein:

the controller is further configured to deactivate printheads in the printer when the web width change decreases.

* * * * *